US010213662B2

(12) United States Patent
Seluga et al.

(10) Patent No.: US 10,213,662 B2
(45) **Date of Patent: *Feb. 26, 2019**

(54) GOLF CLUB HEAD HAVING STIFFENING MEMBERS AND VARIABLE FACE THICKNESS

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/866,986

(22) Filed: Jan. 10, 2018

(65) Prior Publication Data

US 2018/0126234 A1 May 10, 2018

Related U.S. Application Data

(63) Continuation of application No. 15/452,516, filed on Mar. 7, 2017, now Pat. No. 9,908,016, which is a continuation-in-part of application No. 15/279,188, filed on Sep. 28, 2016, now Pat. No. 9,687,701, which is a continuation of application No. 14/847,227, filed (Continued)

(51) Int. Cl.
*A63B 53/04* (2015.01)

(52) U.S. Cl.
CPC .... *A63B 53/0466* (2013.01); *A63B 2053/045* (2013.01); *A63B 2053/0408* (2013.01); *A63B 2053/0412* (2013.01); *A63B 2053/0433* (2013.01); *A63B 2053/0437* (2013.01); *A63B 2053/0458* (2013.01); *A63B 2053/0491* (2013.01); *A63B 2209/023* (2013.01); *A63B 2225/02* (2013.01)

(58) Field of Classification Search
CPC .. A63B 53/04; A63B 53/06; A63B 2053/0791
USPC ..... 473/324, 329, 330, 334, 340, 342
See application file for complete search history.

(56) References Cited

U.S. PATENT DOCUMENTS 5,000,454 A * 3/1991 Soda ..... A63B 53/04 473/346
6,319,150 B1 * 11/2001 Werner ..... A63B 53/04 473/349

(Continued)

*Primary Examiner* — William M Pierce
(74) *Attorney, Agent, or Firm* — Rebecca Hanovice; Michael Catania; Sonia Lari

(57) ABSTRACT

A golf club head comprising a body, a variable face thickness pattern, and a plurality of solid metal stiffening rods, and which satisfies the equation $V_{ballnorm} \geq 0.0356x+140.82$, is disclosed herein. The body comprises a face, a sole, and a return section, and defines a hollow interior. Each of the rods extends from the return section to the sole within the hollow interior proximate the face to reduce stresses placed on the face during impact with a golf ball. The rods are all located within 1 inch of a rear surface of the face measured along a plane normal to the center of the face, and are spaced a distance of 0.500 to 2.00 inch from one another within the hollow interior. The variable face thickness pattern preferably comprises a plurality of concentric rings, with a center ring having a thickness that is less than a thickness of an intermediary ring.

20 Claims, 8 Drawing Sheets

Related U.S. Application Data on Sep. 8, 2015, now Pat. No. 9,486,677, which is a continuation-in-part of application No. 14/285,479, filed on May 22, 2014, now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, now Pat. No. 9,814,947, and a continuation-in-part of application No. 14/788,326, filed on Jun. 30, 2015, now Pat. No. 9,597,558, said application No. 14/794,578 is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, and a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/989,956, filed on Nov. 1, 2013, provisional application No. 61/684,079, filed on Aug. 16, 2012, provisional application No. 61/665,203, filed on Jun. 27, 2012.

(56) References Cited

U.S. PATENT DOCUMENTS

| | | | | |
|---|---|---|---|---|
| 6,354,962 | B1 * | 3/2002 | Galloway | A63B 53/02 473/342 |
| 6,368,234 | B1 * | 4/2002 | Galloway | A63B 60/00 473/349 |
| 6,428,426 | B1 * | 8/2002 | Helmstetter | A63B 53/04 473/330 |
| 6,508,722 | B1 * | 1/2003 | McCabe | A63B 53/04 473/330 |
| 6,899,638 | B2 * | 5/2005 | Iwata | A63B 53/04 473/329 |
| 7,029,403 | B2 * | 4/2006 | Rice | A63B 53/0466 473/329 |
| 7,347,794 | B2 * | 3/2008 | Schweigert | A63B 53/0466 473/342 |
| 7,549,934 | B2 * | 6/2009 | Rice | A63B 60/00 473/329 |
| 8,262,501 | B2 * | 9/2012 | Curtis | A63B 53/0466 473/329 |
| 8,272,975 | B2 * | 9/2012 | Morin | A63B 53/0466 473/342 |
| 8,956,246 | B2 * | 2/2015 | Myrhum | A63B 53/0466 473/342 |

* cited by examiner

GOLF CLUB HEAD HAVING STIFFENING MEMBERS AND VARIABLE FACE THICKNESS

CROSS REFERENCES TO RELATED APPLICATIONS

The present invention is a continuation of U.S. patent application Ser. No. 15/452,516, filed on Mar. 7, 2017, which is a continuation-in-part of U.S. patent application Ser. No. 15/279,188, filed on Sep. 28, 2016, and issued on Jun. 27, 2017, as U.S. Pat. No. 9,687,701, which is a continuation of U.S. patent application Ser. No. 14/847,227, filed on Sep. 8, 2015, and issued on Nov. 8, 2016, as U.S. Pat. No. 9,486,677, which is a continuation-in-part of U.S. patent application Ser. No. 14/788,326, filed on Jun. 30, 2015, and issued on Mar. 21, 2017, as U.S. Pat. No. 9,597,588, and which is also a continuation-in-part of U.S. patent application Ser. No. 14/794,578, filed on Jul. 8, 2015, and issued on Nov. 14, 2017, as U.S. Pat. No. 9,814,947, which is a continuation-in-part of U.S. patent application Ser. No. 14/755,068, filed on Jun. 30, 2015, and issued on Apr. 18, 2017, as U.S. Pat. No. 9,623,302, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012, the disclosure of each of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having a variable face thickness pattern and stress-reducing metal rods connecting an upper, return portion with a sole portion via a hollow interior and disposed proximate the face.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head and Method of Making the Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head of the present invention comprises variable face thickness and interior structures connecting a return or crown section to a sole section to reduce the stress in a striking face section during impact with a golf ball. In some embodiments, the interior structures are hollow tubes or solid rods composed of a titanium alloy.

One aspect of the present invention is a golf club head comprising a body comprising a striking face section, a sole section extending from a lower edge of the striking face section, and a crown section extending from an upper edge of the striking face section, the striking face section, sole section, and crown section defining a hollow body interior, and at least one stiffening member disposed within the hollow body interior and extending from the crown section to the sole section, wherein the striking face section comprises a rear face surface facing the hollow body interior, wherein the at least one stiffening member is located no more than 1 inch from the rear face surface along a vertical plane extending through the face center perpendicular to the striking face section, wherein no portion of the at least one stiffening member makes contact with the striking face section, wherein the golf club head satisfies the equation $V_{ballnorm} \geq 0.0356x+140.82$, and wherein $$V_{ballnorm} = \frac{m_h V_{inh} + m_h V_{inh} \left[ \frac{V_{cr}}{V_{cin}}\left(1+\frac{m_b}{m_c}\right) + \frac{m_b}{m_c} + \frac{V_{br}}{V_{bin}}\left(1+\frac{m_b}{m_p}\right) + \frac{m_b}{m_p} - 0.822 \right]}{m_h + m_b}.$$

In a further embodiment, the golf club head may satisfy the equation $V_{ballnorm} \geq 0.0356x+141.19$.

In some embodiments, the at least one stiffening member may comprise first and second stiffening members, the first stiffening member may extend approximately parallel with the second stiffening member, and the first stiffening member may be spaced a distance of 0.75 to 1.50 inch from the second stiffening member. In a further embodiment, each of the first and second stiffening members may comprise a structure selected from the group consisting of a solid rod and a hollow tube. In another, further embodiment, each of the first and second stiffening members may be a solid rod composed of a metal material selected from the group consisting of titanium alloy and steel. In an alternative embodiment, the at least one stiffening member may be located no more than 0.25 inch from the rear face surface along the vertical plane extending through the face center perpendicular to the striking face section. In a further embodiment, the at least one stiffening member may include an upper end proximate the crown section and a lower end proximate the sole section, the upper end may be spaced a first distance from the rear face surface, the lower end may be spaced a second distance from the rear face surface, and the first distance may be less than the second distance. In any of these embodiments, the golf club head may further comprise a cover piece, the sole section may include a plurality of cutouts, and the cover piece may be secured to the sole section and at least partially cover each of the plurality of cutouts. Also in any of these embodiments, the golf club head may comprise a crown insert, the crown section may comprise an upper opening, and the crown insert may cover the upper opening.

Another aspect of the current invention is golf club head comprising a metal body comprising a striking face section, a sole section extending from a lower edge of the striking face section, and a return section extending from an upper edge of the striking face section, the return section and sole section defining an upper opening, and the striking face section, sole section, and return section defining a hollow body interior, and first and second stiffening members disposed within the hollow body interior and extending from the return section to the sole section, wherein each of the first and second stiffening members is a solid metal rod, wherein no portion of either the first or second stiffening member makes contact with the striking face section, wherein the golf club head satisfies the equation $V_{ballnorm} \geq 0.0356x + 140.82$, and wherein $$V_{ballnorm} = \frac{m_h V_{inh} + m_h V_{inh}}{\left[\frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822\right]}{m_h + m_b}.$$

In a further embodiment, the golf club head may comprise a crown insert that may be permanently affixed to the body to close the upper opening. In some embodiments, the crown insert may be composed of a carbon composite material, and each of the first and second stiffening members may be integrally cast with the body.

In another embodiment, the golf club head may comprise a carbon composite cover piece, the sole section may comprise at least one cutout, and the cover piece may be permanently affixed to the sole section to cover the at least one cutout. In yet another embodiment, each of the first and second stiffening members may have a length of 1.00 inch to 2.50 inches, the first stiffening member may extend approximately parallel with the second stiffening member, and the first stiffening member may be spaced a distance of 0.500 to 2.00 inch from the second stiffening member. In still another embodiment, the striking face section may comprise a face center and a rear face surface, and each of the first and second stiffening members may be located no more than 0.500 inch from the rear face surface along a vertical plane extending through the face center perpendicular to the striking face section.

Yet another aspect of the present invention is a golf club head comprising a metal body comprising a striking face section, a sole section extending from a lower edge of the striking face section, a return section extending from an upper edge of the striking face section, and an aft end opposite the striking face section, the return section and sole section defining an upper opening, and the striking face section, sole section, and return section defining a hollow body interior, first and second stiffening members disposed within the hollow body interior and extending from the return section to the sole section, and a carbon composite crown insert permanently affixed to the body to close the upper opening, wherein each of the first and second stiffening members is located closer to the striking face section than to the aft end within the hollow body interior, wherein the golf club head has a volume of 420 cubic centimeters to 470 cubic centimeters, wherein the golf club head satisfies the equation $V_{ballnorm} \geq 0.0356x + 141.19$, and wherein $$V_{ballnorm} = \frac{m_h V_{inh} + m_h V_{inh}}{\left[\frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822\right]}{m_h + m_b}.$$

In some embodiments, the first stiffening member may comprise an upper end proximate the return section and a lower end proximate the sole section, the upper end may be spaced a first distance from the striking face section, and the lower end may be spaced a second distance from the striking face section that is greater than the first distance. In a further embodiment, the first distance is 0.120 inch may be 0.150 inch, and the second distance may be 0.180 inch to 0.210 inch. In another embodiment, each of the first and second stiffening members may have a length of 1.00 inch to 2.50 inches, the first stiffening member may extend approximately parallel with the second stiffening member, and the first stiffening member may be spaced a distance of 0.75 inch to 1.50 inch from the second stiffening member.

Another aspect of the present invention is a golf club head comprising a metal body comprising a striking face section, a sole section extending from a lower edge of the striking face section, a return section extending from an upper edge of the striking face section, and an aft end opposite the striking face section, the return section and sole section defining an upper opening, and the striking face section, sole section, and return section defining a hollow body interior, a crown section sized to cover the upper opening, and a first metal rod disposed within the hollow body interior and extending from the return section to the sole section, the first metal rod comprising an upper end and a lower end, wherein the striking face section comprises an interior surface, a geometric center, a face boundary, a central thickness region having a first thickness, a first intermediate thickness region having a second thickness, and a second intermediate thickness region having a third thickness, wherein the face boundary comprises the upper and lower edges of the striking face section, wherein the first thickness is greater than the second thickness and less than the third thickness, wherein the upper end is spaced a first distance from the interior surface, wherein the lower end is spaced a second distance from the interior surface, wherein the second distance is greater than the first distance, wherein no portion of the first metal rod is spaced further than 1.00 inch from the interior surface along an x-axis extending perpendicular to the striking face section, wherein the golf club head satisfies the equation $V_{ballnorm} \geq 0.0356x + 140.82$, and wherein $$V_{ballnorm} = \frac{m_h V_{inh} + m_h V_{inh}}{\left[\frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822\right]}{m_h + m_b}.$$

In some embodiments of the present invention, the golf club head may satisfy the equation $V_{ballnorm} \geq 0.0356x + 141.19$. In other embodiments, the central thickness region may be defined as an area of the striking face section located between the geometric center and 25% of a radial distance from the geometric center to the face boundary, the first intermediate thickness region may be defined as an area of the striking face section located between 26% and 59% of a radial distance from the geometric center to the face boundary, and the second intermediate thickness region may be defined as an area of the striking face section located between 60% and 90% of a radial distance from the geometric center to the face boundary. In other embodiments, the first thickness may range from 0.100 inch to 0.150 inch, the second thickness may range from 0.020 inch to 0.100 inch, and the third thickness may range from 0.130 inch to 0.170 inch. In a further embodiment, the first thickness may be approximately 0.125 inch, the second thickness may be approximately 0.060 inch, and the third thickness may be approximately 0.152 inch. In an alternative embodiment, the golf club head may further comprise a boundary thickness region, which may be defined as an area of the striking face section located between 90% and 100% of a radial distance from the geometric center to the face boundary, and the boundary thickness region may have a fourth thickness that is greater than the second thickness and less than the first thickness. In some embodiments, the fourth thickness may range from 0.080 to 0.120 inch, and in a further embodiment, the fourth thickness may be approximately 0.105 inch.

In another embodiment, the golf club head may further comprise a plurality of ribs and a boundary thickness region, which may be defined as an area of the striking face section located between 90% and 100% of a radial distance from the geometric center to the face boundary. In this embodiment at least one of the plurality of ribs may extend from the boundary thickness region to one of the return section and the sole section. In a further embodiment, each of the plurality of ribs may extend from the boundary thickness region to one of the return section and the sole section. In a further embodiment, the plurality of ribs may comprise three ribs, and each of which may extend from the boundary thickness region to the return section.

In another embodiment, the golf club head may further comprise a second metal rod disposed within the hollow body interior and extending from the return section to the sole section. In this embodiment, the first metal rod may be spaced a distance of 0.75 to 1.50 inch from the second metal rod along a horizontal y-axis extending parallel with the striking face section, and no portion of the second metal rod may be spaced further than 1.00 inch from the interior surface along the x-axis. In a further embodiment, each of the first and second metal rods is entirely located within 0.25 inch of the interior surface along the x-axis.

Another aspect of the present invention is a driver-type golf club head comprising a metal body comprising a striking face section with a face boundary, a sole section extending from a lower portion of the face boundary, a return section extending from an upper portion of the face boundary, and an aft end opposite the striking face section, the return section and sole section defining an upper opening, and the striking face section, sole section, and return section defining a hollow body interior, a carbon composite crown section sized to cover the upper opening, the crown section permanently affixed to the body with an adhesive material, and first and second solid metal rods disposed within the hollow body interior, wherein each of the first and second solid metal rods extending from the return section to the sole section, wherein the first solid metal rod is spaced from the second solid metal rod a distance of 0.500 inch to 2.00 inches along a y-axis extending parallel with the striking face section, wherein the striking face section comprises an interior surface facing the hollow body interior, a geometric center, a first ring having a first thickness encircling the geometric center, a second ring having a second thickness encircling the first ring, and a third ring having a third thickness encircling the second ring, wherein the first thickness is greater than the second thickness and less than the third thickness, wherein no portion of either of the first and second metal rods is spaced further than 0.500 inch from the interior surface along an x-axis extending perpendicular to the striking face section, wherein the driver-type golf club head has a volume of 200 cubic centimeters to 470 cubic centimeters, wherein the driver-type golf club head has a mass of 180 grams to 210 grams, wherein the driver-type golf club head has a characteristic time of less than 257 μs, wherein the driver-type golf club head satisfies the equation $V_{ballnorm} \geq 0.0356x+140.82$, and wherein $$V_{ballnorm} = \frac{m_h V_{inh} + m_h V_{inh} \left[ \frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822 \right]}{m_h + m_b}.$$

In some embodiments, each of the metal body and the first and second solid metal rods may be composed of a titanium alloy. In other embodiments, the first thickness may range from 0.100 inch to 0.150 inch, the second thickness may range from 0.020 inch to 0.100 inch, and the third thickness may range from 0.130 inch to 0.170 inch. In a further embodiment, the first thickness may be approximately 0.125 inch, the second thickness may be approximately 0.060 inch, and the third thickness may be approximately 0.152 inch. In another embodiment, the driver-type golf club head may comprise fourth ring having a fourth thickness encircling the third ring. In this embodiment, the fourth thickness may be greater than the second thickness and less than the third thickness. In yet another embodiment, the driver-type golf club may comprise a sole cover piece. In this embodiment, the sole section may comprise a plurality of cutouts, and the cover piece may be secured to the sole section so that it at least partially covers each of the plurality of cutouts. In yet another embodiment, each of the first and second solid metal rods may be integrally cast with the body.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
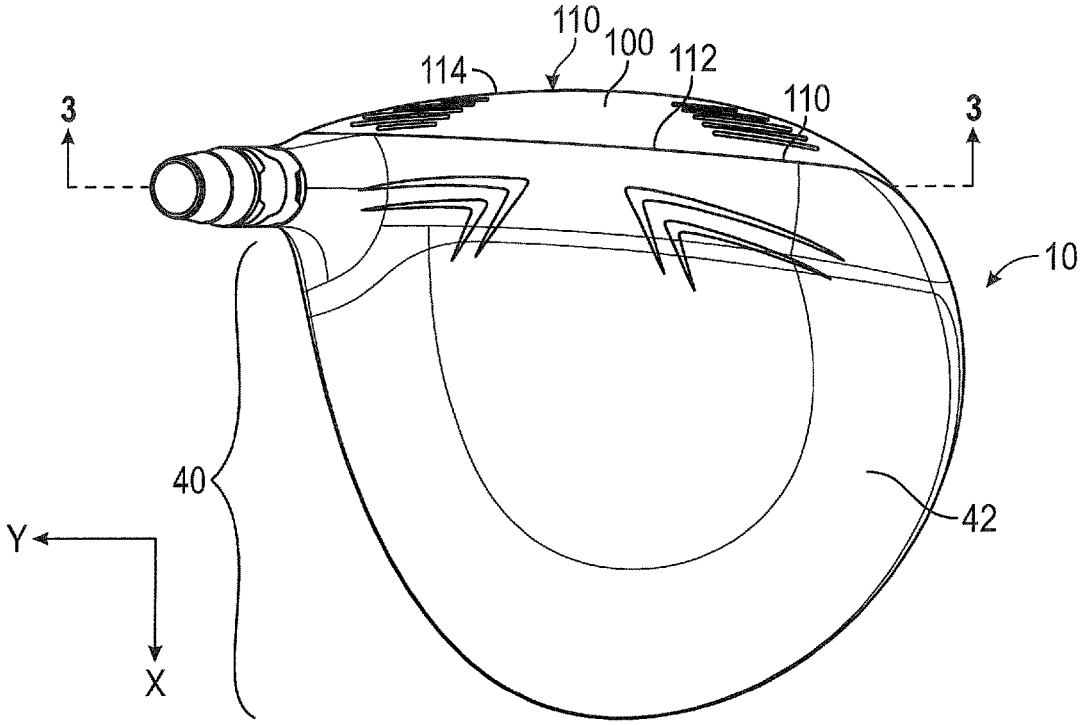
FIG. 1 is a top elevational view of the preferred embodiment of the golf club head of the present invention.
Figure 2:
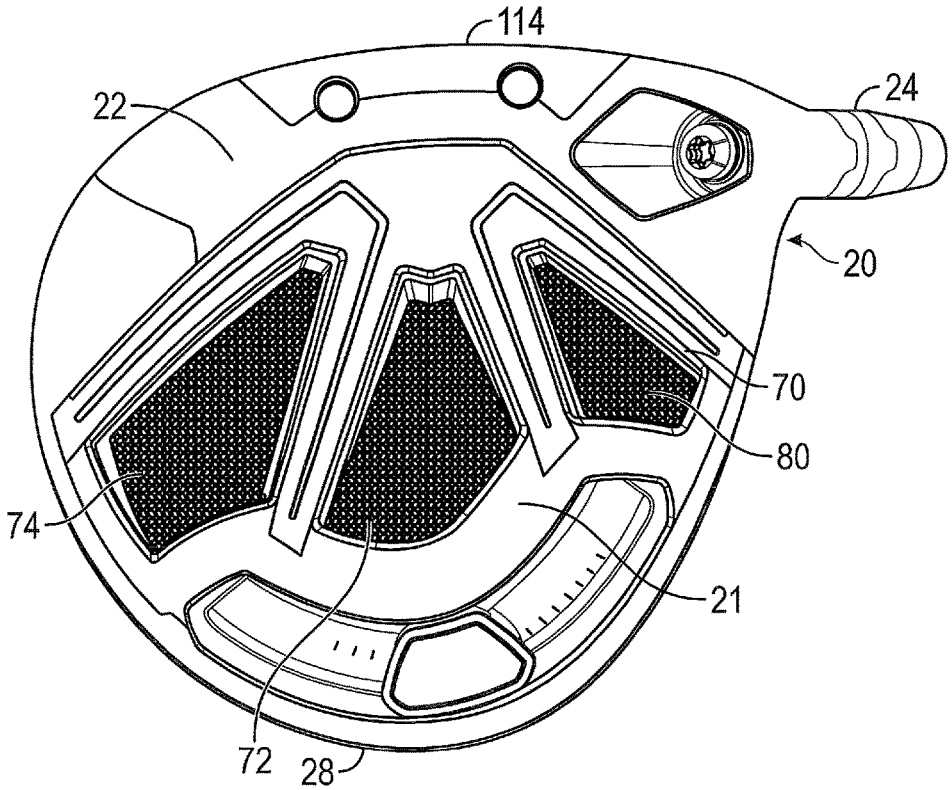
FIG. 2 is a sole elevational view of the golf club head shown in FIG. 1.

As shown in FIGS. 1-11, a preferred embodiment of the golf club head 10 of the present invention is generally designated. The golf club head 10 includes a body 20 having a striking face section 100 with a geometric face center 105 and a boundary 110 or edge region, a return section 32 extending rearwards away from an upper edge or upper portion 112 of the boundary 110, a sole section 22 extending rearwards away from a lower edge or lower portion 114 of the boundary, a hosel 24 for engaging a shaft, a heel end 23, a toe end 25, an upper opening 26, a hollow interior 27, and an aft end 28. Three internal supporting ribs 36 extend between the return section 32 and a boundary thickness region (defined below) proximate the upper portion 112 of boundary 110; these ribs 36 serve to stiffen the boundary 110, and may also be disposed between the boundary thickness region and the sole section 22. A crown section 40 is comprised of the return section 32 and a crown insert 42 that is placed over the upper opening 26 to enclose the hollow interior 27. The body 20 also includes three cutouts 70, 72, 74 in a center area 21 of the sole section 22, which are closed by a cover piece 80 having a density that is lower than the density of the material used to make the body 20. Each of the crown section 40 and cover piece 80 preferably is composed of a carbon composite material, while the body 20 is composed of a metal material such as titanium alloy or steel.

Within the hollow interior 27, two stiffening members 50, 52 extend from the sole section 22 upward to the return section 32 approximately parallel with the rear surface 120 of the striking face section 100 and with each other. In an alternative embodiment, the stiffening members 50, 52 may extend to the crown insert 42 instead; what is important is that the stiffening members 50, 52 connect the crown section 40 to the sole section 22 proximate the striking face section 100, without making contact with any portion of the striking face section 100, even when the striking face section 100 impacts a golf ball. The stiffening members 50, 52 must, in any event, be closer to the striking face section 100 than to the aft end 28 of the body 20.

Figure 3:
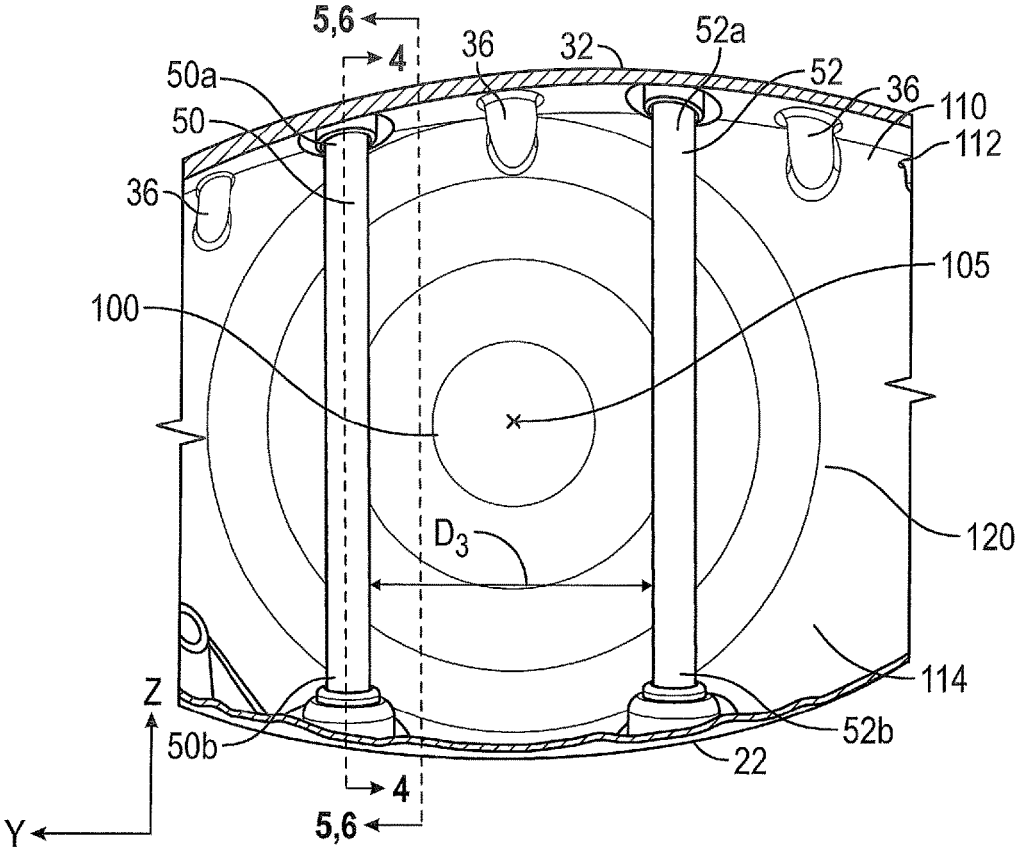
FIG. 3 is a cross-sectional view of the golf club head shown in FIG. 1 along lines 3-3.
Figure 4:
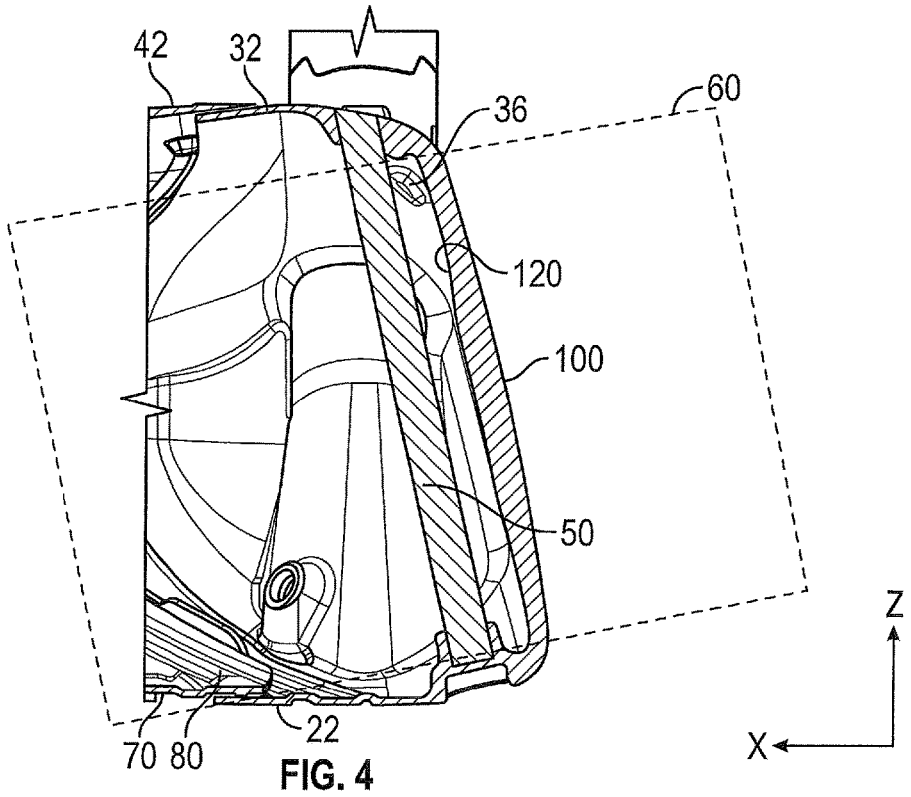
FIG. 4 is a cross-sectional view of the golf club head shown in FIG. 3 along lines 4-4.
Figure 5:
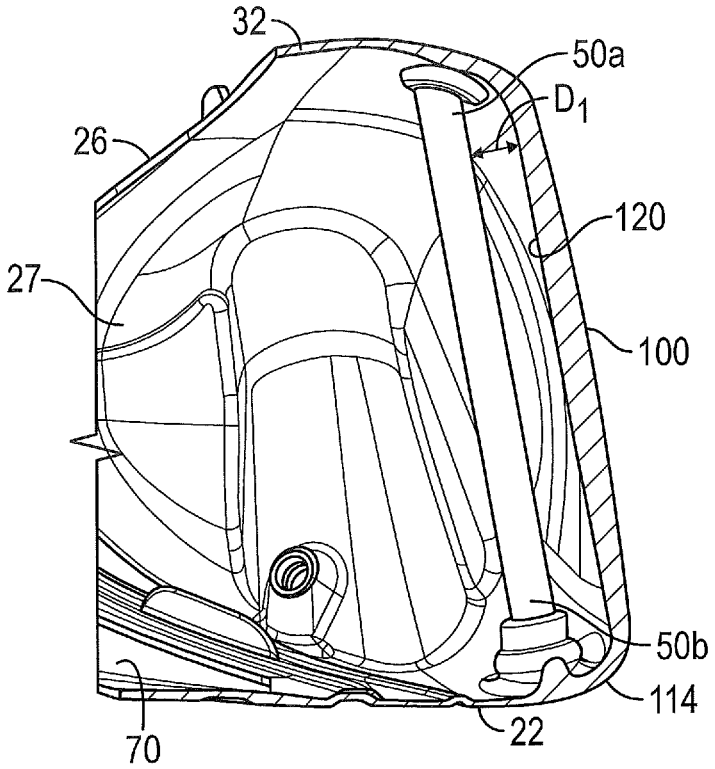
FIGS. 5-6 are cross-sectional views of the golf club head shown in FIG. 3 along lines 5-5 and 6-6, respectively.
Figure 6:
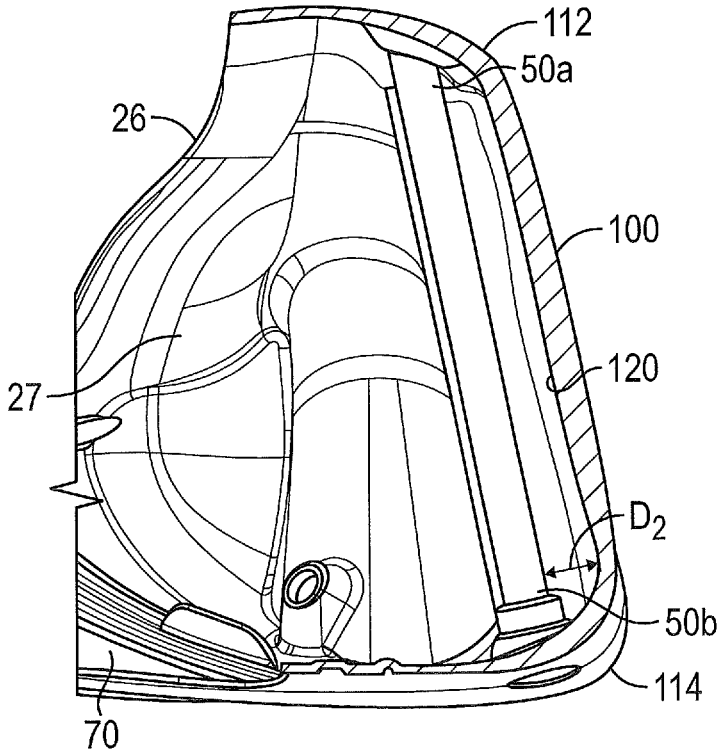
Figure 7:
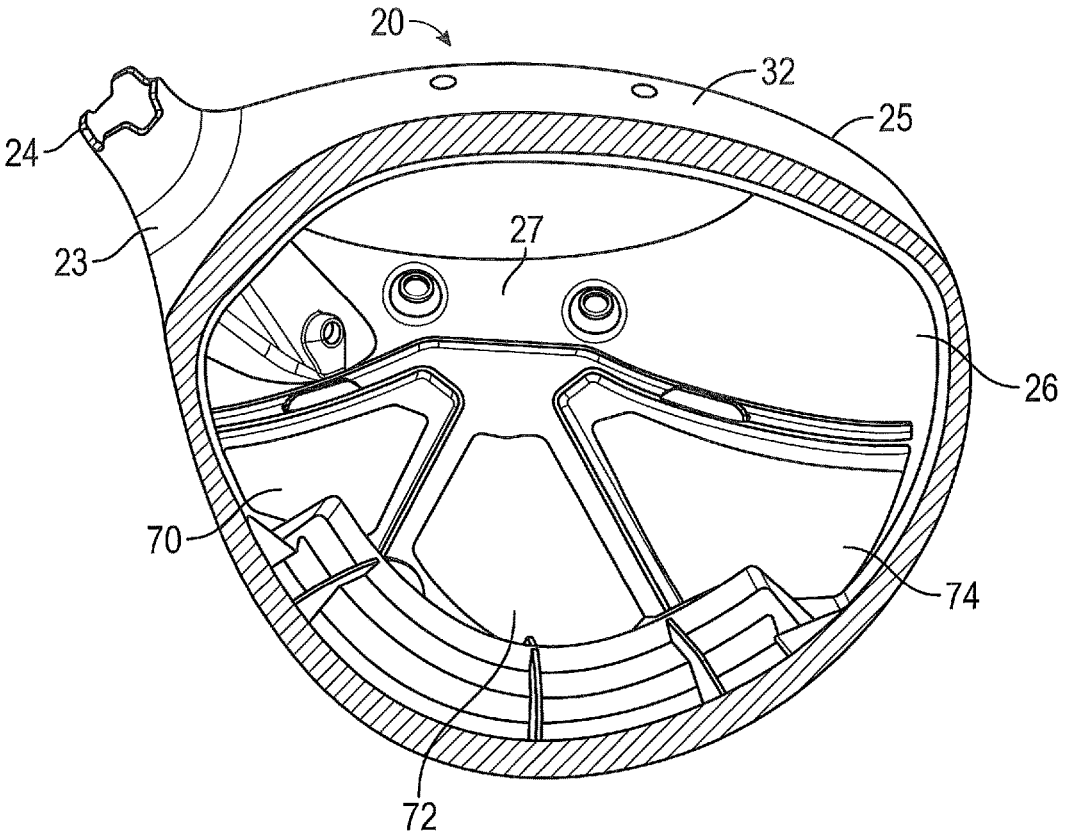
FIG. 7 is a top perspective view of the golf club head shown in FIG. 1 with its crown insert and sole cover piece removed.
Figure 8:
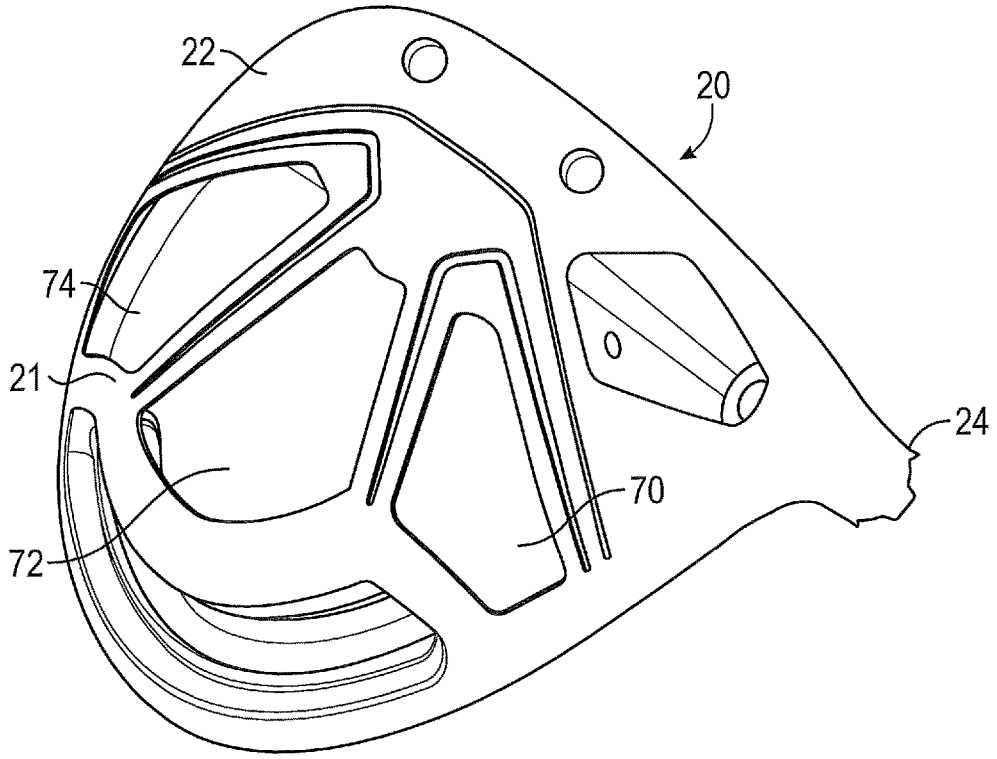
FIG. 8 is a sole perspective view of the embodiment shown in FIG. 7.
Figure 9:
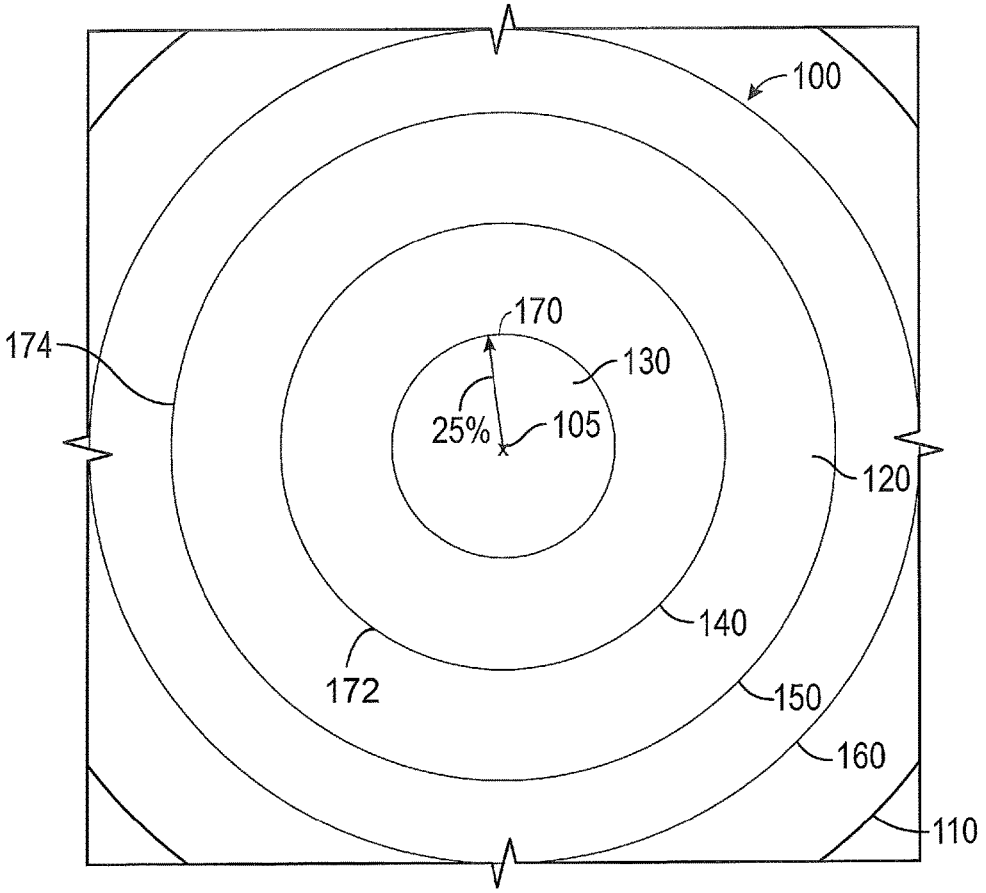
FIG. 9 is an elevational view of the rear surface of the striking face section.
Figure 10:
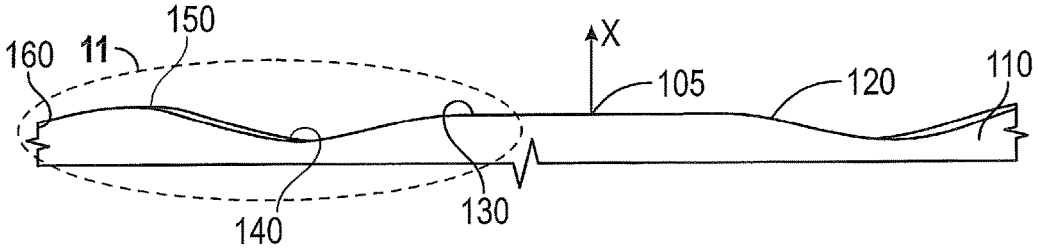
FIG. 10 is a cross-sectional view of the striking face section shown in FIG. 9 along lines 10-10.
Figure 11:
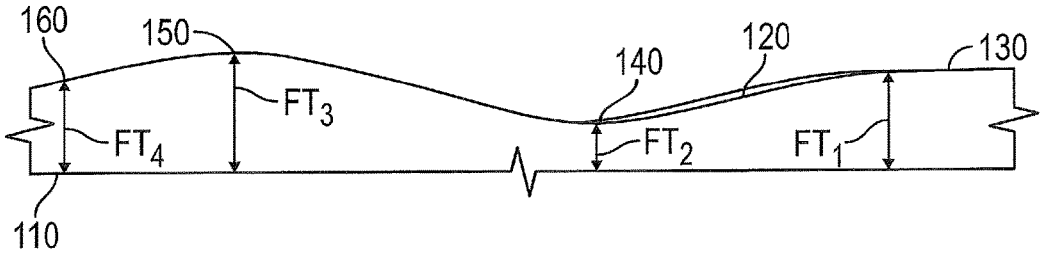
FIG. 11 is an enlarged view of the circled portion of the embodiment shown in FIG. 10.

As shown in FIG. 3, the preferred embodiment has two stiffening members 50, 52, each of which is a solid rod composed of a lightweight, strong metal material such as titanium alloy or steel, though in an alternative embodiment the stiffening members 50, 52 each may be a hollow tube or other hollow structure made of a strong lightweight metal or a composite material. Though the stiffening members 50, 52 of the preferred embodiment are cylindrical, with circular cross-sectional shapes, in other embodiments they may have square, triangular, rectangular, or other geometric cross-sectional shapes. In another embodiment, the golf club head 10 may include both the solid rod and hollow types of stiffening members 50. The stiffening members 50, 52 preferably are co-cast with the body 20 using a wax molding process, such as the one disclosed in U.S. Provisional Patent Application No. 62/442,892, the disclosure of which is hereby incorporated by reference in its entirety herein, though in alternative embodiments may be added after the body 20 is manufactured and secured to the body 20 via welding, brazing, solder, or adhesive, and/or mechanically.

In the preferred embodiment, each of the stiffening members 50, 52 has a diameter of 0.050 inch to 0.200 inch and a length of 1 to 2.5 inches. The stiffening members 50, 52 are both located within 1 inch of the rear surface 120 of the striking face section 100 measured along a vertical, xz plane 60 extending through the geometric face center 105 perpendicular to the striking face section 100. No portion of any stiffening member 50, 52 should be located outside of this 1-inch range; in fact, it is more preferable for each stiffening member 50, 52 to be located even closer to the rear surface 120 of the striking face section 30. In the preferred embodiment, the stiffening members are spaced 0.136 inch to 0.210 inch from the rear surface 120, with the upper end 50*a*, 52*a* of each stiffening member 50, 52 spaced a distance $D_1$ that is slightly closer to the rear surface 120 than the spacing $D_2$ of the lower end 50*b*, 52*b*. In the preferred embodiment, $D_1$ ranges from 0.120 inch to 0.150 inch, while $D_2$ ranges from 0.180 inch to 0.210 inch. The stiffening members 50, 52 are also spaced from one another by a distance $D_3$ of 0.500 to 2.00 inch, more preferably approximately 0.75 to 1.50 inch, and most preferably approximately 1.00 inch. This positioning of the stiffening members 50, 52 optimizes the normalized ball speed relationship to Characteristic Time (CT), as measured in μs by the U.S. Golf Association (USGA) CT test, and as described in greater detail below with respect to FIGS. 12-15. Locating the stiffening members 50, 52 within the region of the golf club head 10 defined above also has the greatest stress-reducing effect on the golf club head 10 as a whole. If any of the stiffening members 50, 52 are placed more than 1 inch away from the rear surface 120 of the striking face section 100, they do not have a noticeable effect on the stress placed on the striking face section 100 when the golf club head 10 is in use, and use discretionary mass without providing a significant performance benefit.

The stiffening members' 50, 52 reduction of stress on the striking face section 100 during impact with a golf ball also has the beneficial effect of freeing up mass from the striking face section 100; in other words, mass can be removed from, or moved around on, the striking face section 100, because less material is required in the striking face section 100 to withstand impact. The striking face section 100 of the inventive golf club head 10 may have a uniform thickness, or any of the variable face thickness patterns disclosed in U.S. Pat. Nos. 7,448,960, 6,398,666, 6,471,603, 6,368,234, all of which are owned by Callaway Golf Company, and the disclosures of which are hereby incorporated by reference in their entireties herein. However, it is preferable that the striking face section 100 have the variable thickness pattern illustrated in FIGS. 3 and 9-11: a central ring 130 or thickness region encircling the geometric face center 105 and having a first thickness $FT_1$, a second ring 140 or first intermediate thickness region encircling the central ring 130 and having a second thickness $FT_2$ that is less than the first thickness $FT_1$, a third ring 150 or second intermediate thickness region having a third thickness $FT_3$ that is greater than the first thickness $FT_1$, and a fourth ring 160 or boundary thickness region having a fourth thickness $FT_4$ that is greater than the second thickness $FT_2$ and less than the first thickness $FT_1$. In the preferred embodiment, $FT_1$ preferably ranges from 0.100 to 0.150 inch, and more preferably approximately 0.125 inch, $FT_2$ ranges from 0.020 to 0.100 inch, more preferably 0.060 inch, $FT_3$ ranges from 0.130 to 0.170 inch, more preferably approximately 0.152 inch, and $FT_4$ ranges from 0.080 to 0.120 inch, more preferably approximately 0.105 inch. Each thickness measurement is taken along the x-axis extending perpendicular to the striking face section 100.

The central ring 130 preferably is defined by the area between the geometric center 105 and a first margin 170 demarcating 25% of a radial distance from the geometric center 105 to the boundary 110. The second ring 140 is defined by the area between the first margin 170 and a second margin 172 demarcating 59% of the radial distance from the geometric center 105 to the boundary, or between 26% and 59% of the radial distance. The third ring 150 is defined by the area between the second margin 172 and a third margin 174 demarcating 90% of the radial distance, or between 60% and 90% of the radial distance, while the fourth ring 160 is defined as the area of the striking face section 100 disposed between the third margin 174 and the boundary, or 90% to 100% of the radial distance.

Table 1 illustrates the performance benefits of the variable face thickness pattern of the present invention compared with a constant face thickness and an elliptical variable thickness pattern in which the central ring 130 has the greatest thickness. The CT preferably is under the limit of 257 μs, and the slope from a CT test preferably is positive. As shown in this Table and in FIG. 15, if the third ring 150 has a thickness that is less than or equal to the thickness of the central ring 130, the ballspeed to CT relationship is negatively affected.

TABLE I

| | Central Ring 130 (0-25%) | Second Ring 140 (26-59%) | Third Ring 150 (60-90%) | Fourth Ring 160 (90-100%) | CT | Slope | Normalized Ball Speed Value |
|---|---|---|---|---|---|---|---|
| Constant Thickness | 0.13 inch | 0.13 inch | 0.13 inch | 0.13 inch | 246 | −9.42 | 148.34 |
| Third Ring < Central Ring | 0.127 inch | 0.06 inch | 0.124 inch | 0.092 inch | 275 | 6.8 | 149.64 |
| Third Ring > Central Ring | 0.1248 inch | 0.06 inch | 0.152 inch | 0.105 inch | 246 | 15.5 | 149.65 |

Normalized ball speed removes the variable effect of a golf club head's mass and loft, and the construction of a particular golf ball, from testing the speed of a golf ball upon impact with any given golf club head, including the golf club head 10 of the present invention; in other words, it allows an apples-to-apples comparison of golf club head performance. Normalized ball speed can be determined for a golf club head using the following steps, which are also outlined in the flow chart of FIG. 14.

Figure 12:
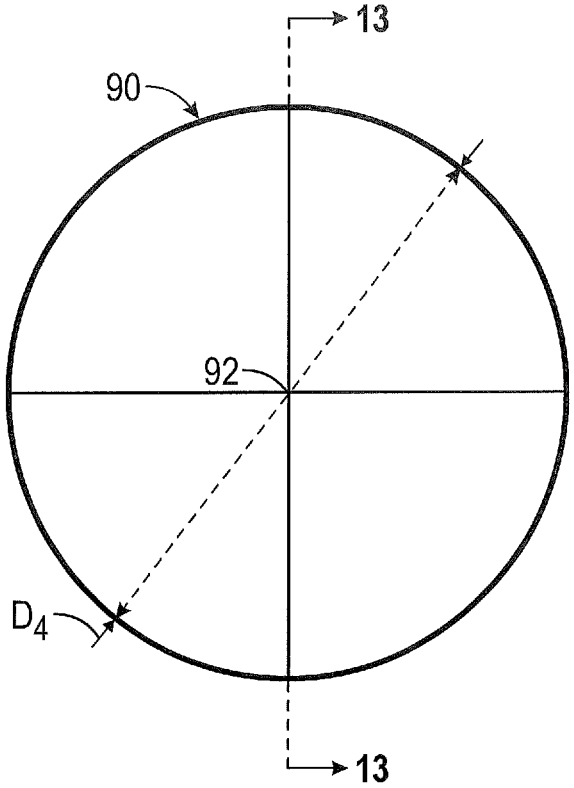
FIG. 12 is a top plan view of an exemplary calibration plate used to calculate normalized ball speed of a golf club head.
Figure 13:
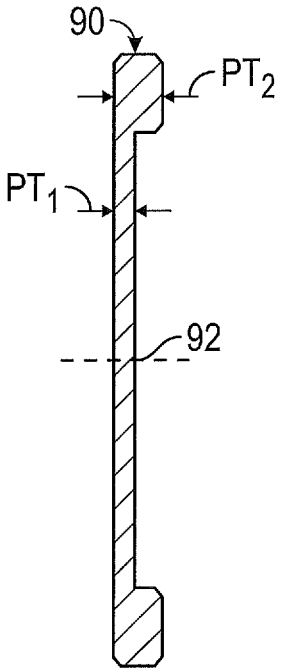
FIG. 13 is a cross-sectional view of the calibration plate shown in FIG. 10 along lines 13-13.
Figure 14:
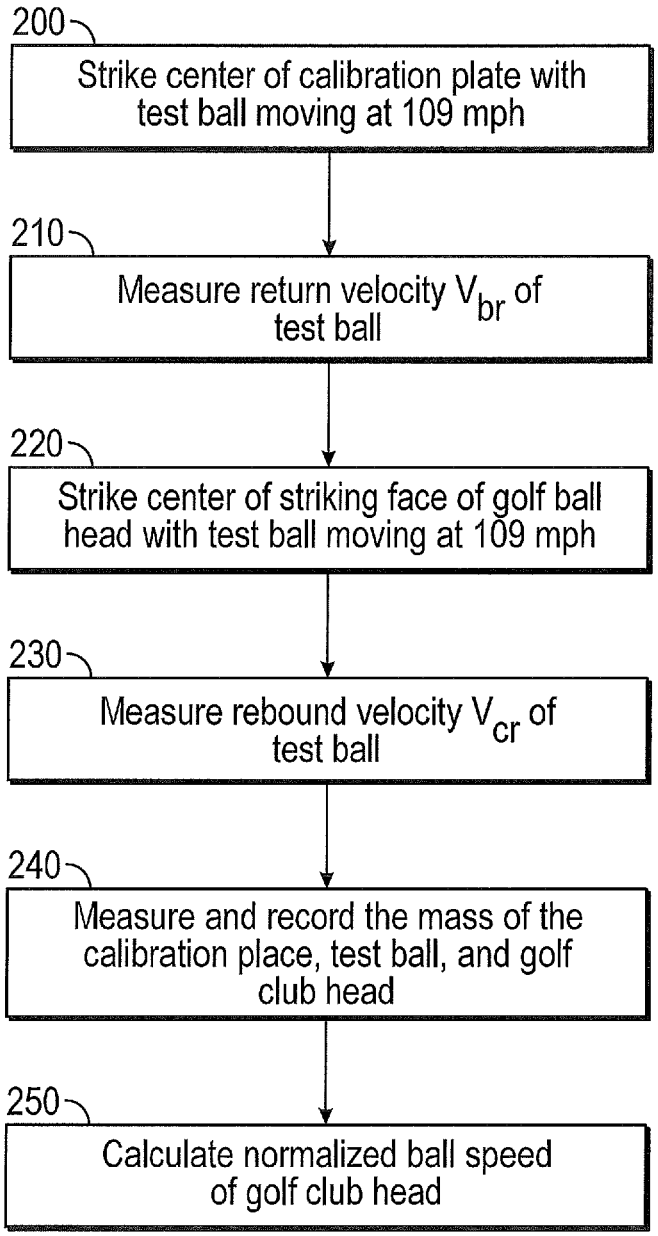
FIG. 14 is a flow chart describing how to calculate the normalized ball speed of a golf club head, including the embodiment shown in FIG. 1.

First, provide a titanium 6-4 calibration plate 90 with a mass of approximately 190 grams, a diameter $D_4$ of approximately 4 inches, a minimum plate thickness $PT_1$ of approximately 0.100-0.150 inch, and a maximum plate thickness $PT_2$ of approximately 0.200-0.400 inch, as shown in FIGS. 12 and 13, and strike the center 92 of the calibration plate with a test golf ball moving at approximately 109 mph (step 200). Measure the return velocity $V_{br}$ of the ball (step 210). Then, strike the same test golf ball, again traveling at approximately 109 mph, with the center 105 of the striking face section 100 of the golf club head 10 being assessed (step 220), and measure the rebound velocity $V_{cr}$ of the test golf ball (step 230). Next, measure and record the mass of the plate $m_p$, golf ball $m_b$, golf club head 10 $m_c$, measured head test ball in velocity (109 mph target) $V_{an}$, measured plate test ball in velocity (109 mph target) $V_{bin}$, measured head test ball return velocity $V_{cr}$, and measured plate test ball return velocity $V_{br}$ (step 240). Finally, calculate the normalized ball speed ($V_{ballnorm}$) using the following equation (step 250):

$$V_{ballnorm} = \frac{m_h V_{inh} + m_h V_{inh} \left[ \frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822 \right]}{m_h + m_b}$$

In this equation, $V_{inh}$ is 100 and $m_h$ is 200.

Figure 15:
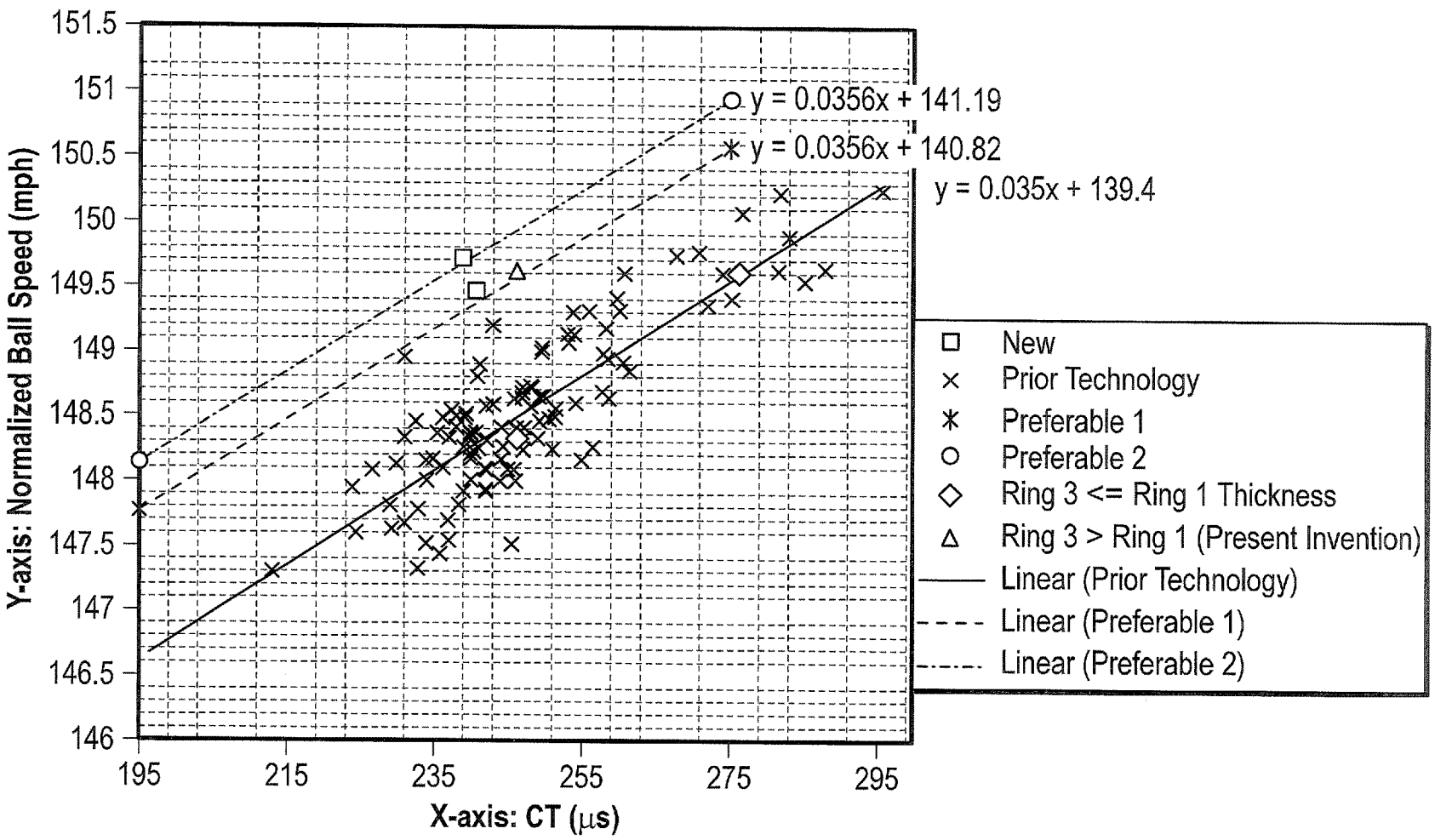
FIG. 15 is a graph showing the relationship between normalized ball speed (y-axis) and Characteristic Time (μs) (x-axis) of prior art golf club heads and the inventive golf club head described herein.

The golf club head 10 of the present invention has a $V_{ballnorm} \geq 0.0356x+140.82$, and more preferably a $V_{ballnorm} \geq 0.0356x+141.19$, wherein the "x" variable is the CT of the golf club head 10. The positioning of the stiffening members 50, 52 of the present invention allows the golf club head 10 to have improved ball speed and thus satisfy this equation. In fact, as shown in FIG. 15, prior art golf club heads, which do not include the stiffening member 50, 52 structure or the variable face thickness pattern of the present invention, fall well short of this performance metric.

When the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The disclosures of U.S. patent application Ser. Nos. 14/997,199, 15/051,361, 15/385,549, 15/423,347, 15/432,655, and 62/442,892, each of which is assigned to Callaway Golf Company, are hereby incorporated by reference in their entireties herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face section, a sole section extending from a lower edge of the striking face section, a return section extending from an upper edge of the striking face section, an upper opening, and an aft end opposite the striking face section, the return section disposed between the striking face section and the upper opening;

a crown section affixed to the body to close the upper opening and define a hollow body interior; and a stiffening member disposed within the hollow body interior and extending from the return section to the sole section, the stiffening member comprising an upper end connected to the return section and a lower end connected to the sole section, wherein the striking face section comprises an interior surface facing the hollow interior, a geometric center, a face boundary, a central thickness region having a first thickness, a first intermediate thickness region having a second thickness, and a second intermediate thickness region having a third thickness, wherein the face boundary comprises the upper and lower edges of the striking face section, wherein the first thickness is greater than the second thickness and less than the third thickness, wherein the first thickness ranges from 0.100 inch to 0.150 inch, wherein the second thickness ranges from 0.020 inch to 0.100 inch, wherein the third thickness ranges from 0.130 inch to 0.170 inch, wherein no portion of the stiffening member is spaced further than 0.500 inch from the interior surface along a vertical plane extending perpendicular to the striking face section, and wherein no portion of the stiffening member makes contact with the striking face section during impact with a golf ball.

2. The golf club head of claim 1, wherein the central thickness region is defined as an area of the striking face section located between the geometric center and 25% of a radial distance from the geometric center to the face boundary, wherein the first intermediate thickness region is defined as an area of the striking face section located between 26% and 59% of a radial distance from the geometric center to the face boundary, and wherein the second intermediate thickness region is defined as an area of the striking face section located between 60% and 90% of a radial distance from the geometric center to the face boundary.

3. The golf club head of claim 1, wherein the first thickness is approximately 0.125 inch, wherein the second thickness is approximately 0.060 inch, and wherein the third thickness is approximately 0.152 inch.

4. The golf club head of claim 3, further comprising a boundary thickness region defined as an area of the striking face section located between 90% and 100% of a radial distance from the geometric center to the face boundary, wherein the boundary thickness region has a fourth thickness that is greater than the second thickness and less than the first thickness.

5. The golf club head of claim 4, wherein the fourth thickness ranges from 0.080 to 0.120 inch.

6. The golf club head of claim 5, wherein the fourth thickness is approximately 0.105 inch.

7. The golf club head of claim 4, further comprising a plurality of ribs, wherein at least one of the plurality of ribs extends from the boundary thickness region to one of the return section and the sole section.

8. The golf club head of claim 7, wherein each of the plurality of ribs extends from the boundary thickness region to one of the return section and the sole section.

9. The golf club head of claim 8, wherein the plurality of ribs comprises three ribs, and wherein each of the three ribs extends from the boundary thickness region to the return section.

10. The golf club head of claim 1, wherein the stiffening member is located entirely within 0.25 inch of the interior surface along the vertical plane.

11. A wood-type golf club head comprising:

a metal body comprising a striking face section with a face boundary, a sole section extending from a lower portion of the face boundary, a return section extending from an upper portion of the face boundary, an upper opening, and an aft end opposite the striking face section, the return section disposed between the striking face section and the upper opening;

a crown section affixed to the body to close the upper opening and define a hollow body interior, and first and second solid metal rods disposed within the hollow body interior, wherein each of the first and second solid metal rods extends from the return section to the sole section, wherein no portion of either of the first and second metal rods is spaced further than 0.500 inch from the interior surface along a vertical plane extending perpendicular to the striking face section, wherein the first solid metal rod is spaced from the second solid metal rod a distance of 0.500 inch to 2.00 inches along a y-axis extending parallel with the striking face section, wherein the striking face section comprises an interior surface facing the hollow body interior, a geometric center, a first ring having a first thickness encircling the geometric center, a second ring having a second thickness encircling the first ring, a third ring having a third thickness encircling the second ring, and a fourth ring having a fourth thickness encircling the third ring, wherein the first ring is defined as an area of the striking face section located between the geometric center and 25% of a radial distance from the geometric center to the face boundary, wherein the second ring is defined as an area of the striking face section located between 26% and 59% of a radial distance from the geometric center to the face boundary, wherein the third ring is defined as an area of the striking face section located between 60% and 90% of a radial distance from the geometric center to the face boundary, wherein the fourth ring is defined as an area of the striking face section located between 90% and 100% of a radial distance from the geometric center to the face boundary, wherein the first thickness is greater than the second thickness and less than the third thickness, wherein the fourth thickness is greater than the second thickness and less than the first thickness and the third thickness, and wherein the wood-type golf club head has a characteristic time of less than 257 μs.

12. The wood-type golf club head of claim 11, wherein each of the metal body and the first and second solid metal rods is composed of a titanium alloy.

13. The wood-type golf club head of claim 11, wherein the first thickness ranges from 0.100 inch to 0.150 inch, wherein the second thickness ranges from 0.020 inch to 0.100 inch, wherein the third thickness ranges from 0.130 inch to 0.170 inch, and wherein the fourth thickness ranges from 0.080 inch to 0.120 inch.

14. The wood-type golf club head of claim 13, wherein the first thickness is approximately 0.125 inch, wherein the second thickness is approximately 0.060 inch, wherein the third thickness is approximately 0.152 inch, and wherein the fourth thickness is approximately 0.105 inch.

15. The wood-type golf club head of claim 11, wherein each of the first and second solid metal rods is integrally cast with the body.

16. The wood-type golf club head of claim 11, wherein the first solid metal rod extends approximately parallel with the second solid metal rod.

17. The wood-type golf club head of claim 11, wherein at least one of the first and second solid metal rods has a circular cross-sectional shape.

18. The wood-type golf club head of claim 11, wherein the crown section is composed of a carbon composite material.

19. The wood-type golf club head of claim 11, wherein at least one of the first and second solid metal rods is co-cast with the body.

20. The wood-type golf club head of claim 11, further comprising at least one rib extending between the fourth ring and one of the return section and sole section.

* * * * *